US006305085B1

(12) United States Patent
Stallegger et al.

(10) Patent No.: US 6,305,085 B1
(45) Date of Patent: Oct. 23, 2001

(54) CLASP KNIFE

(76) Inventors: Harald Stallegger, Bilrothstrasse 24, A-5020 Salzburg; Sami Stinner, Egger Lienz Gasse 15/27, A-5020 Salzburg, both of (AT)

( * ) Notice: Subject to any disclaimer, the term of this patent is extended or adjusted under 35 U.S.C. 154(b) by 0 days.

(21) Appl. No.: 09/587,599

(22) Filed: Jun. 5, 2000

(30) Foreign Application Priority Data

Jun. 4, 1999 (AT) ..... 997/99

(51) Int. Cl.[7] ..... B26B 1/04
(52) U.S. Cl. ..... 30/161; 30/160
(58) Field of Search ..... 30/155, 161, 160, 30/331; 81/489, 177.1, 177.7

(56) References Cited

U.S. PATENT DOCUMENTS

| | | | | |
|---|---|---|---|---|
| 701,686 | * | 3/1902 | Day | 30/161 |
| 4,083,110 | | 4/1978 | Goldin et al. | 30/161 X |
| 4,536,959 | | 8/1985 | Ross | 30/161 |
| 4,947,551 | | 8/1990 | Deisch | 30/161 |
| 5,953,821 | | 9/1999 | Mearns | 30/161 |

FOREIGN PATENT DOCUMENTS 2 174 947 11/1986 (GB) .

* cited by examiner

*Primary Examiner*—Douglas D. Watts
(74) *Attorney, Agent, or Firm*—Herbert Dubno

(57) ABSTRACT

A clasp knife has a handle lying generally in a plane and forming an elongated recess extending longitudinally in the plane, open laterally of the plane, and having an outer longitudinally open end formed with a retaining formation. A pivot pin at the outer end defines an axis substantially parallel to the plane and transverse to the recess. A blade lying generally in a plane including the axis has a cutting edge extending generally perpendicular to the axis adjacent the axis, pivots on the pin about the axis between a closed position received in the recess and an extended position with the blade plane generally coplanar with the handle plane, moves limitedly axially relative to the handle between a pair of end positions, and has a formation fitting complementary with the handle formation in one of the end positions. A spring braced axially between the blade and the body urges the blade into the one end position. A catch element is displaceable between a holding position engaging the blade in the extended position thereof and retaining the blade in the extended position and a releasing position out of engagement with the blade.

6 Claims, 3 Drawing Sheets

CLASP KNIFE

FIELD OF THE INVENTION

The present invention relates to a clasp knife.

BACKGROUND OF THE INVENTION

A standard clasp knife comprises a generally planar blade pivoted on an elongated handle between an open or extended position with the plane of the blade and the longitudinal axis of the handle aligned or coinciding and a folded or closed position with the blade recessed in a pocket formed in the handle. In U.S. Pat. No. 4,083,110 of Goldin the handle is basically U-shaped and the blade pivots about an axis lying in the plane of the blade. When folded the blade is surrounded by the U-shaped handle. When extended there is, however, no system for holding the blade in place so that this knife is quite difficult and even dangerous to use.

U.S. Pat. No. 4,947,551 of Deisch pivots similarly but a catch is provided to hold the blade in the extended position. While this structure is quite a bit safer than the Goldin system, the knife is quite complex. It is therefore expensive to manufacture and is fairly bulky even when folded up. Operating the catch takes two hands, making the device inconvenient to use.

While the knife of U.S. Pat. No. 4,536,959 of Ross has a catch and is of fairly simple construction, the system for holding the blade in the extended position is not very reliable. It relies on the user tightly gripping the handle in a certain way to maintain the blade lock. It is relatively easy to inadvertently release the blade so that this system is also fairly dangerous to use.

U.S. Pat. No. 5,953,821 of Mearns works like the Goldin system with a U-shaped handle. The catch is fairly weak in this system so that the blade can be easily unlatched. In U.S. Pat. No. 2,174,947 of Barsby another such system is shown where the catch is also quite weak and could release the blade or, at the very least, allow it to wobble while cutting.

OBJECTS OF THE INVENTION

It is therefore an object of the present invention to provide an improved clasp knife.

Another object is the provision of such an improved clasp knife which overcomes the above-given disadvantages, that is which is of simple and inexpensive construction, which can be operated with one hand, and which securely locks the blade in the extended position.

SUMMARY OF THE INVENTION

A clasp knife has according to the invention a handle lying generally in a plane and forming an elongated recess extending longitudinally in the plane, open laterally of the plane, and having an outer longitudinally open end formed with a retaining formation. A pivot pin at the outer end defines an axis substantially parallel to the plane and transverse to the recess. A blade lying generally in a plane including the axis has a cutting edge extending generally perpendicular to the axis adjacent the axis, pivots on the pin about the axis between a closed position received in the recess and an extended position with the blade plane generally coplanar with the handle plane, moves limitedly axially relative to the handle between a pair of end positions, and has a formation fitting complementary with the handle formation in one of the end positions. A spring braced axially between the blade and the body urges the blade into the one end position. A catch element is displaceable between a holding position engaging the blade in the extended position thereof and retaining the blade in the extended position and a releasing position out of engagement with the blade.

Thus this knife is of extremely simple construction, yet the blade is positively retained in the extended position. In this extended position the blade complementarily interfits with the handle so it can be used to cut and pry without moving relative to the handle.

The blade and handle are formed offset from the axis with an axially directed bump and recess that fit together when the blade is in the closed position. Thus the blade is also retained positively in the closed or closed position.

The spring according to the invention urges the bump and recess into engagement with each other in the closed position. In addition the blade is symmetrical to a longitudinally extending line perpendicular to the axis and is formed to each side of the line with one such handle formation. The blade is reversible on the pin to engage either of the handle formations so that the knife can be made right- or left-handed.

An elastic clip carries the catch element. This catch element is a pin carried on the clip and extending substantially perpendicular to the handle plane. It fits in a rearwardly open notch in the blade so that, when the pin is engaged in the notch, the blade cannot move axially on the pin and the blade and handle formations are retained together. The clip must be pulled outward to disengage the catch pin from the notch at the rear end of the blade, something that cannot normally happen when the handle is being grasped as the knife is being used, making it impossible for the knife to fold up when in use.

BRIEF DESCRIPTION OF THE DRAWING

The above and other objects, features, and advantages will become more readily apparent from the following description, reference being made to the accompanying drawing in which.

SPECIFIC DESCRIPTION

Figure 5:
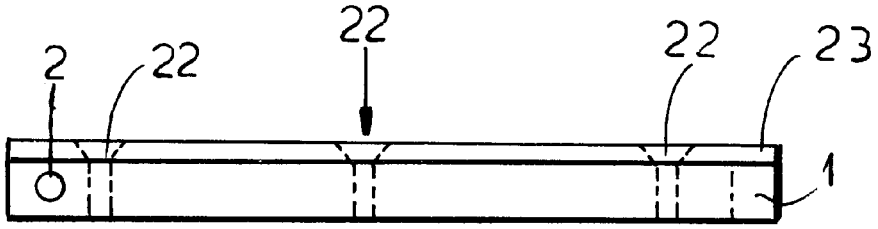
FIG. 5 is an edge view of the handle part of the knife.
Figure 6:
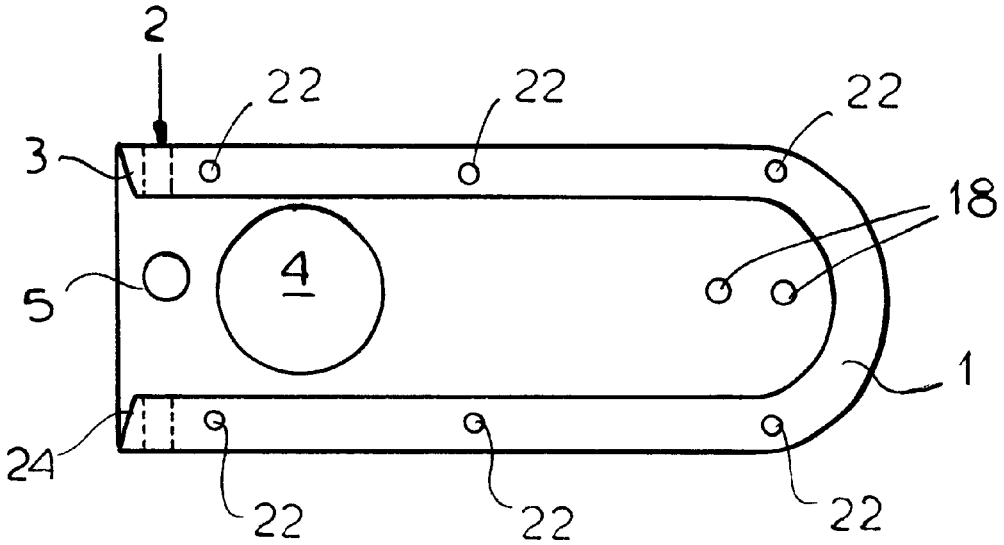
FIG. 6 i a side view of the handle part.

As seen in FIGS. 1 through 4, the knife according to the invention basically comprises a handle 1 on which a blade 8 is pivotal about an axis A, the handle 1 and blade 8 lying in respective planes including the axis A. The handle 1 is basically U-shaped and symmetrical to a longitudinal axis or line L and has a side face closed by a plate 23 secured in place by screw 22 (FIGS. 5 and 6). The front ends of the arms of the U-shaped handle 1 form abutment surfaces 3 and 24 symmetrical to the line L and are formed with aligned threaded bores 2 receiving a pivot pin 15 defining the axis A and passing completely through the blade 8. Ridges 6 are formed on the edges of the handle 1 to make it easier to handle, and the plate 23 is formed with a pair of through-going holes 4 and 5 slightly rearward of the axis A.

The blade 8 fits with a cylindrical bore 12 over the pin 15 so it can both pivot on the pin 15 and slide axially along it.

A spring 16 urges the blade 8 axially in one direction to fit a cutout 9 on the blade complementary with the abutment surface 3, while an opposite cutout 10 on the blade accommodates this spring 16. The back edge of the blade is formed near the axis A with ridges 13 and, somewhat outward therefrom, with a formation or bump 15 that can fit in a complementary formation or recess 7 on an inside face of the handle part 1. In addition a rear edge of the blade 8 is formed with a radially outwardly open cutout or notch 11.

The back face of the plate 23 is provided with a spring-steel clip 17 having a front end turned up at 21 and a rear end secured in place by screws 18. The front end carries a pin 20 that can project through the hole 5 in the plate 23 to fit in the cutout 11 and lock the blade 8 in the position with the formation 9 fitting with the formation 3. This clip 17 is formed with a hole 19 aligned with the hole 4 so that the user can push a finger or thumb through the holes 4 and 19 to move the blade from the folded to the extended position.

Since the handle 1 is symmetrical to the line L perpendicular to the axis A, the blade can be removed and reinstalled so that the blade cutout 9 fits with the surface 24 instead of with the surface 3 for use by a left-hander.

Figure 1:
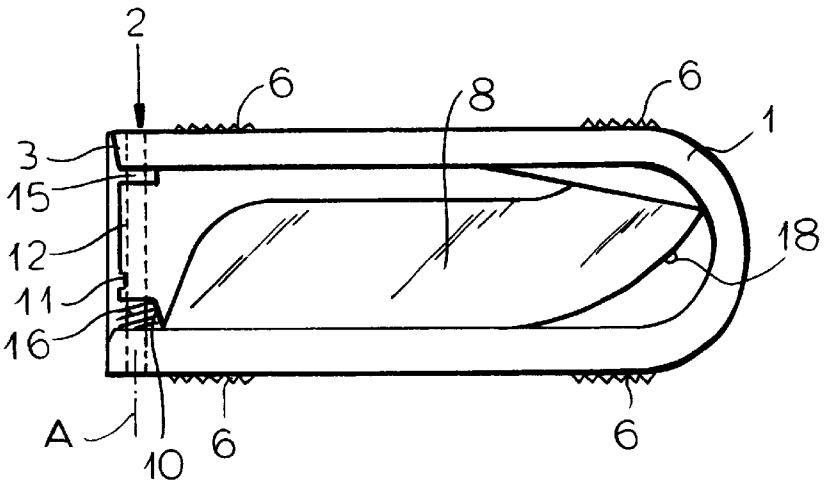
FIG. 1 is a side view of the clasp knife according to the invention in the closed position.
Figure 2:
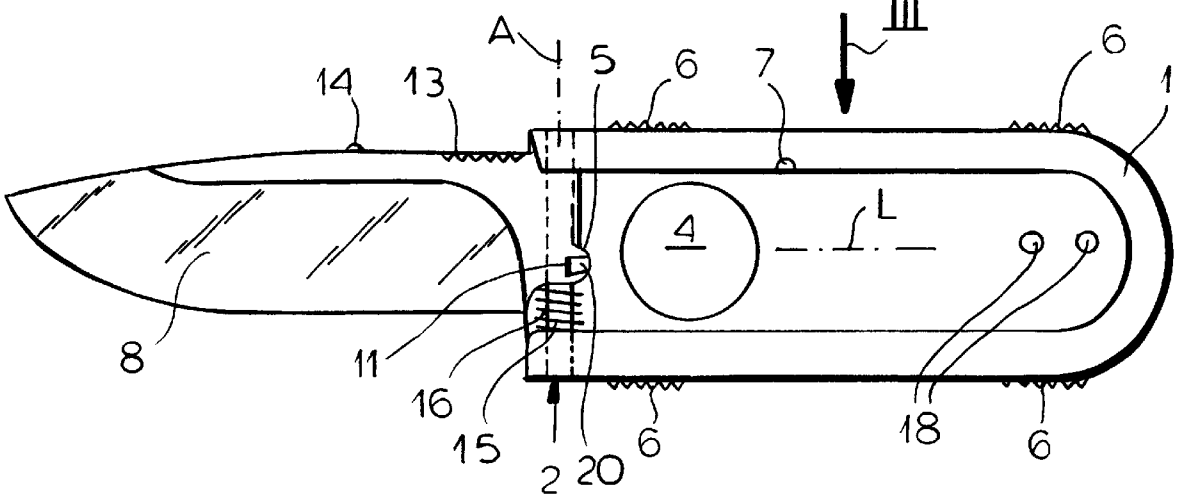
FIG. 2 is a side view of the knife in the extended position.
Figure 3:
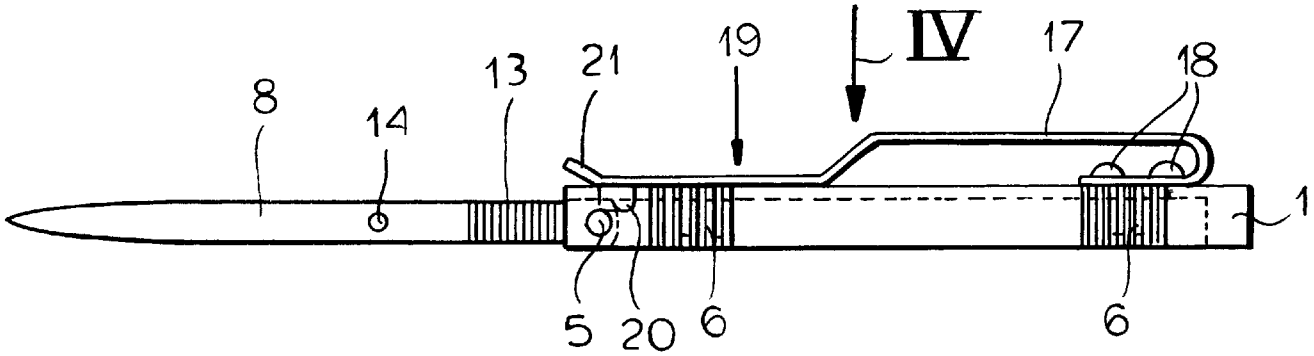
FIG. 3 is a top view taken in the direction of arrow III of FIG. 2.
Figure 4:
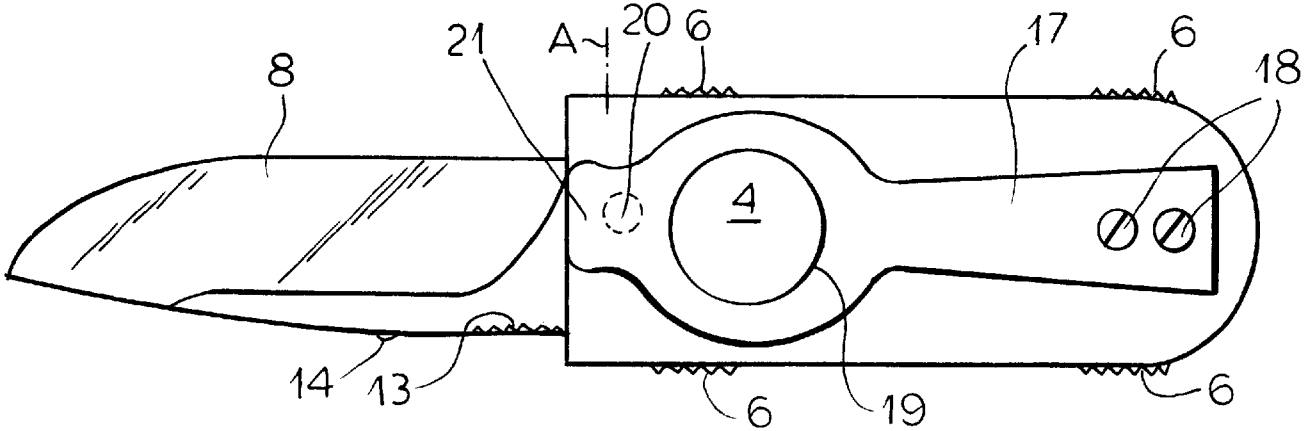
FIG. 4 is a back side view taken in the direction of arrow IV of FIG. 3.

When the blade 8 is in the closed position of FIG. 1 the formations 7 and 14 engage to lightly retain the blade 8 in this position. A light push on the blade 8 through the holes 4 and 19 will disengage these formations 7 and 14 from each other and pivot the blade outward. Once it reaches the extended position of FIG. 2 the spring 16 will push the blade 8 upward as shown in FIG. 2 to allow the pin 20 to drop into the cutout 11 and the cutout 9 to fit with the surface 3, solidly locking the blade 8 in place on the handle 1.

To retract the blade the end 21 of the clip 17 is raised to disengage the pin 20 from the cutout 11 and the blade is pushed by the thumb on the ridges 13 axially downward and then to the side so the blade 8 can pivot back to the FIG. 1 closed position. Once the two formations 7 and 14 interengage the thus folded knife can be safely pocketed.

We claim:

1. A clasp knife comprising:

a handle lying generally in a plane and forming an elongated recess extending longitudinally in the plane, open laterally of the plane, and having an outer longitudinally open end formed with a retaining formation;

a pivot pin at the outer end defining an axis substantially parallel to the plane and transverse to the recess;

a blade lying generally in a plane including the axis, a having a cutting edge extending generally perpendicular to the axis adjacent the axis, pivotal on the pin about the axis between a closed position received in the recess and an extended position with the blade plane generally coplanar with the handle plane, displaceable limitedly axially relative to the handle between a pair of end positions, and having a formation fitting complementary with the handle formation in one of the end positions;

a spring braced axially between the blade and the body and urging the blade into the one end position; and a catch element displaceable between a holding position engaging the blade in the extended position thereof and retaining the blade in the extended position and a releasing position out of engagement with the blade.

2. The clasp knife defined in claim 1 wherein the blade and handle are formed offset from the axis with an axially directed bump and recess that fit together when the blade is in the closed position.

3. The clasp knife defined in claim 2 wherein the spring urges the bump and recess into engagement with each other in the closed position.

4. The clasp knife defined in claim 1 wherein the blade is symmetrical to a longitudinally extending line perpendicular to the axis and is formed to each side of the line with one such handle formation, the blade being reversible on the pin to engage either of the handle formations, whereby the knife can be made right- or left-handed.

5. The clasp knife defined in claim 1 wherein the blade is formed with an elastic clip carrying the catch element.

6. The clasp knife defined in claim 5 wherein the catch element is a pin carried on the clip and extending substantially perpendicular to the handle plane.

* * * * *